US005226810A

United States Patent [19]

Novinsky

[11] Patent Number: 5,226,810

[45] Date of Patent: Jul. 13, 1993

[54] CIGARETTE LIGHTER

[76] Inventor: John Novinsky, 264 Bow Dr., Hauppauge, N.Y. 11788

[21] Appl. No.: 892,271

[22] Filed: Jun. 2, 1992

[51] Int. Cl.[5] ..... F23Q 2/32

[52] U.S. Cl. ..... 431/125; 431/253; 431/255

[58] Field of Search ..... 431/125, 253

[56] References Cited

U.S. PATENT DOCUMENTS

| | | | |
|---|---|---|---|
| 2,480,414 | 8/1949 | Mariani . | |
| 2,493,081 | 1/1950 | Negbaur . | |
| 2,531,056 | 11/1950 | Koesten . | |
| 4,247,283 | 1/1981 | Vidas . | |
| 4,522,583 | 6/1985 | Kraser . | |
| 4,830,606 | 5/1989 | Dillinger | 431/255 |

FOREIGN PATENT DOCUMENTS

| | | | |
|---|---|---|---|
| 664737 | 9/1929 | France | 431/125 |

*Primary Examiner*—Carroll B. Dority
*Attorney, Agent, or Firm*—Collard & Roe

[57] ABSTRACT

A gas fueled pocket cigarette lighter in the form of a miniature boat, including a hollow miniature model boat replica having an opening therein for the cigarette lighter flame to issue therefrom. A cigarette lighter mechanism is housed entirely within the hollow miniature boat, including a fuel tank, and a gas nozzle connected to the fuel tank and positioned at the flame opening of the miniature boat. A gas valve emits gas to the nozzle from the fuel tank and throttles the fuel. An ignition system generates a spark at the nozzle to ignite the fuel exiting therefrom. Means forming part of the miniature model boat activate the ignition system for generating a spark and operate the gas valve to permit fuel to exit from the nozzle.

5 Claims, 3 Drawing Sheets

CIGARETTE LIGHTER

BACKGROUND OF THE INVENTION

1. Field of the Invention

The present invention relates to a cigarette lighter in the form of a miniature boat.

2. Prior Art

Cigarette lighters in various styles, shapes and sizes are known. Some of these cigarette lighters are pocket cigarette lighters and others are ornamental or desktop lighters. Pocket cigarette lighters, for the most part, have been constructed to be primarily functional, having a body which contains a tank for the lighter fluid, whether it be gas or fluid, a valve or wick for expanding the gas or fluid, and a mechanism for igniting the fuel. The ignition for a gas lighter generally includes an electronic or quartz ignition which develops a spark in the vicinity of the fuel valve.

With respect to desktop lighters, since such lighters tend to be relatively large, greater attention has been paid to the aesthetic appearance thereof. Such desktop lighters are often times designed in such a manner that they do not appear to be cigarette or cigar lighters at all, but rather ornaments for adorning the desk of an office or the cocktail or coffee table of a living room. Such desktop lighters come in a large number of ornamental designs, some of which are scaled down versions of everyday objects, and some of which are scaled down versions of unique objects.

Once such attempt at designing a cigarette lighter in the shape of a car is described in U.S. Pat. No. 4,522,583 to Kraser and U.S. Pat. No. 2,531,056 to Koesten. Lighters have also been placed into other objects, for example, the bust of a night in armor, as shown in U.S. Pat. No. 2,493,081 to Negbaur and a captain's wheel, described in U.S. Pat. No. 2,480,414 to Mariani. Lighters have also been placed into musical instruments which are to be played and emit a flame to further enhance the quality of the presentation, as seen in U.S. Pat. No. 4,247,283 to Vidas.

Surprisingly, cigarette lighters in the form of model boats are not available. The model boat could be a sport, ski, off-shore racer, power boat, catamaran, fishing or luxury cruiser. The model boat is an exact reproduction of the life-size boat. The model boat is very detailed, including an interior area showing seats and dashboard.

SUMMARY OF THE INVENTION

It is, therefore, an object of the present invention to provide a cigarette lighter in the form of a boat, in which the model boat is an exact replica of a life-size boat.

It is a further object of the present invention to provide a series of cigarette lighters in the form of boats to provide a collection of different boat designs.

These and other related objects are achieved according to the invention by a gas fueled pocket cigarette lighter in the form of a miniature boat, including a hollow miniature model boat replica having an opening therein for the cigarette lighter flame to issue therefrom. A cigarette mechanism is housed entirely within the hollow miniature boat, including a fuel tank and a gas nozzle connected to the fuel tank and positioned at the flame opening of the miniature boat body. A gas valve admits gas to the nozzle from the fuel tank and throttles the fuel. An ignition system generates a spark at the nozzle to ignite the fuel exiting therefrom. Means forming part of the miniature model boat are provided for activating the ignition system, for generating a spark and for operating the gas valve to permit fuel to exit, from the nozzle.

The gas valve is a slide valve, operatively connected to the gas nozzle for releasing gas through the nozzle in a first position, and throttling gas through the nozzle in a second position. The model boat also includes an activation mechanism for moving the gas valve between the first and second positions. Simultaneously, with movement of the gas valve to the first position, the activation mechanism activates the ignition system to produce a spark at the nozzle, igniting the fuel existing therefrom. The activation mechanism is operated by means forming part of the miniature model boat. The ignition system includes a flint wheel operatively coupled to a flint, whereby rotation of the flint wheel produces a spark at the nozzle. The model boat additionally includes a propeller and outdrive assembly which form the gas valve, and an exhaust pipe which forms the gas nozzle.

Alternatively, the activation mechanism may include biasing means for biasing the activation mechanism to the second position of the gas valve. The activation mechanism includes a guided rod operatively connected to the ignition system and a lever pivotally mounted to the rod at a first end of the rod, having a fulcrum so that movement of the rod moves the gas valve between the first and second positions. The ignition system includes a piezo-electric quartz ignition system. The rod of the activation mechanism generates a spark in the quartz when moved to the first position. Conducting means are provided for transmitting the spark to the gas nozzle. Alternately, the ignition system may include a battery operated electronic ignition system. The rod of the activation mechanism generates a spark in the electronic ignition when moved to the first position and conductor means transmits the spark to the gas nozzle.

The means operating the activation mechanism includes a first exhaust pipe operatively connected thereto. The boat additionally includes a second exhaust pipe formed as the gas nozzle. The boat also has a refill valve assembly forming part of the miniature model boat for refilling the fuel tank. The ignition system may also include a battery operated electronic ignition, with means for activating the ignition system, including a light sensor switch, operatively connected thereto.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
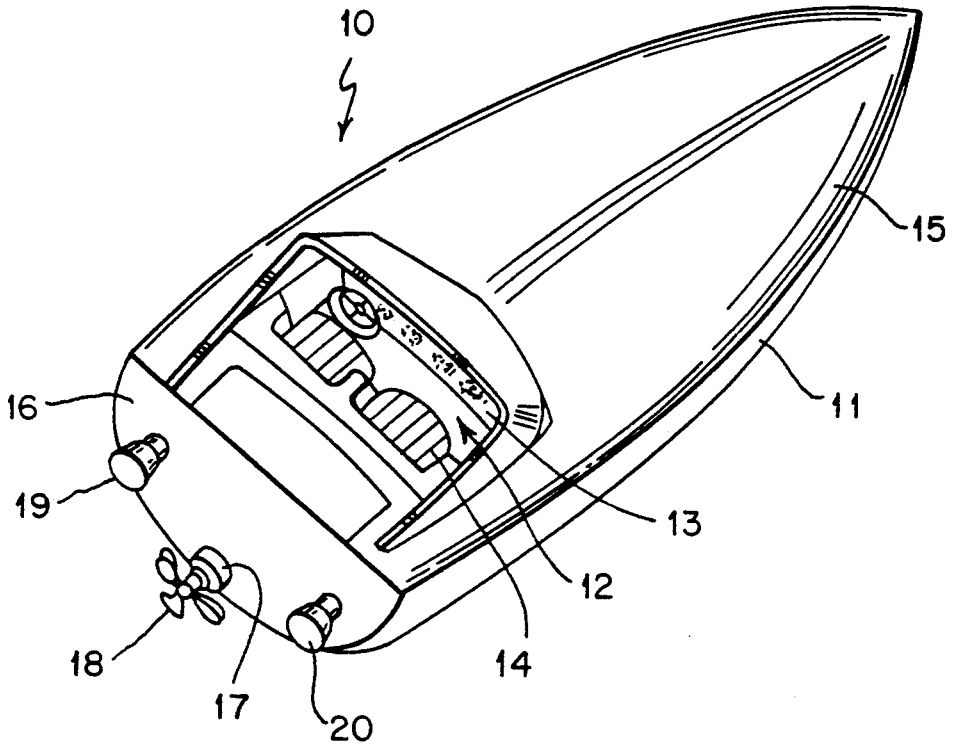
FIG. 1 is a perspective view of a model boat with cigarette lighter, according to the present invention.
Figure 2:
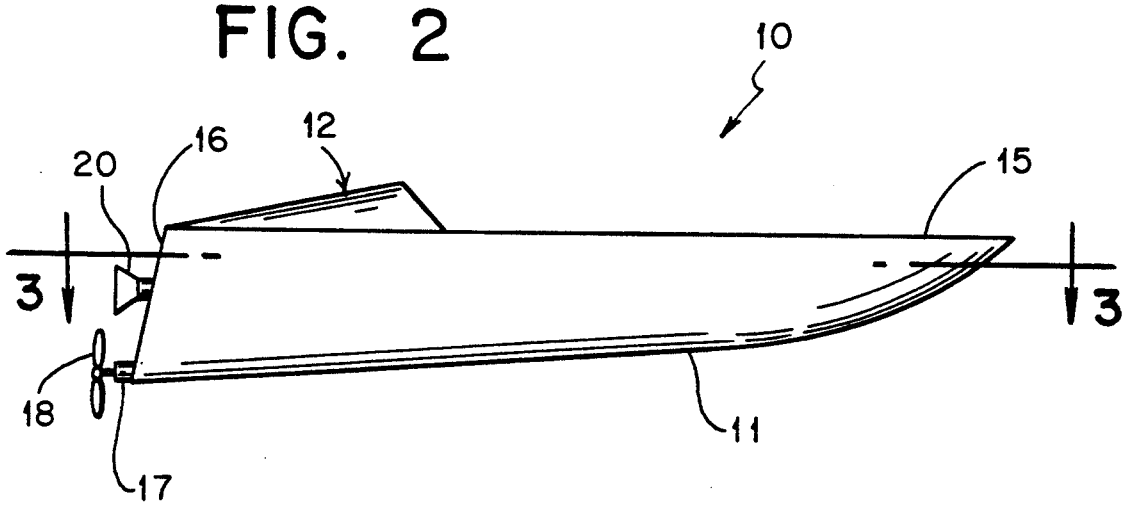
FIG. 2 is a side elevational view of the model boat.

Referring now to the drawings, and in particular FIGS. 1 and 2, there is shown a cigarette lighter 10 which is an exact replica of a life-size boat. Cigarette lighter 10 is small enough so as to be readily hand-held and fit within the user's pocket. As can be clearly appreciated from the appearance of cigarette lighter 10, the elements of the cigarette lighter mechanism are imperceptible to the viewer. In other words, the cigarette lighter 10 is unmarred by extraneous and unsightly elements attributable to the cigarette lighter itself. Cigarette lighter 10 includes a hull 11 and a cockpit 12. Within cockpit 12 there is a control console 13 and seats 14. Forward of cockpit 12 is a foredeck 15. Rear of cockpit 12 is a transom 16. Mounted on to transom 16 are an outdrive 17, a propeller 18, a left exhaust port 19, and a right exhaust port 20.

Figure 3:
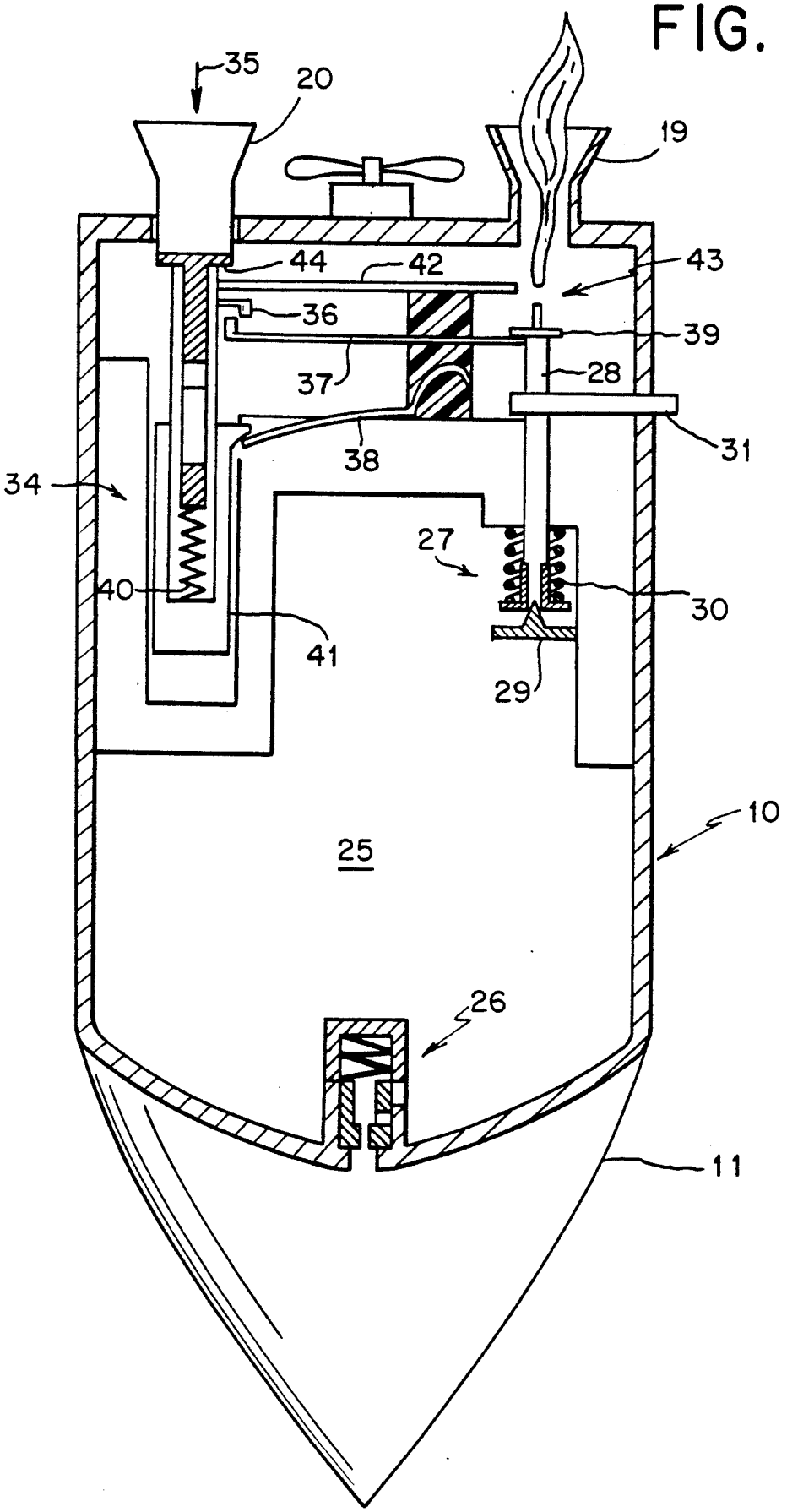
FIG. 3 is a cross-sectional view of the model boat along line 3—3 of FIG. 2.

The various elements of the lighter can be seen in FIG. 3. A butane fuel cell 25 fills the majority of the area within hull 11. A refill valve assembly 26 is provided which is accessible from the bottom of cigarette lighter 10. Butane fuel cell 25 can be refilled through refill valve assembly 26 in the conventional manner. When the lighter is in use, the butane is released through butane release valve 27. Butane release valve 27 includes a metallic tube or slide valve 28 which is ordinarily sealed against stopper 29 by the biasing force of a spring 30. Slide valve 28, when opened, releases butane from fuel cell 25 to left exhaust port 19.

To release butane through slide valve 28, right exhaust port 20 is depressed in the direction of arrow 35, so that an arm 36 pivots a valve plate 37 against a pivot plate 38. The end of valve plate 37, opposite arm 36, presses against a flange 39 which is attached to slide valve 28. As slide valve 28 moves toward left exhaust port 19, it overcomes the biasing force of spring 30 and moves away from stopper 29. Butane then enters slide valve 28 and exits in the vicinity of left exhaust port 19.

Depression of right exhaust port 20 in the direction of arrow 35 overcomes the biasing effect of a spring 40. Right exhaust port 20 and spring 40 are part of a conventional piezoelectric quartz ignition system 34. When right exhaust port 20 is fully depressed in the direction of arrow 35, the quartz crystal is depressed and a potential is created between a sleeve 41 of piezo-electric quartz ignition system 34 and contact 44. Sleeve 41 is electrically coupled to slide valve 28 by pivot plate 38 and valve plate 37. Contact 44 is electrically coupled to a spark plate 42. As a result, a spark is created in gap 43 between spark plate 42 and slide valve 28.

Depression of right exhaust port 20 simultaneously causes butane fuel to be released through slide valve 28 and generates a spark in gap 43 to ignite the fuel, which then exits as a flame from left exhaust port 19. A flame adjustor 31 is coupled to slide valve 28 for adjusting the height of the flame. Since exhaust ports 19 and 20 are used to ignite the lighter and emit the flame, the aesthetics of model boat 10 are not in any way compromised. An individual who observed cigarette lighter 10 would not notice any elements belonging to a lighter, but would merely observe a model boat which is an exact replica of a real boat.

Figure 4:
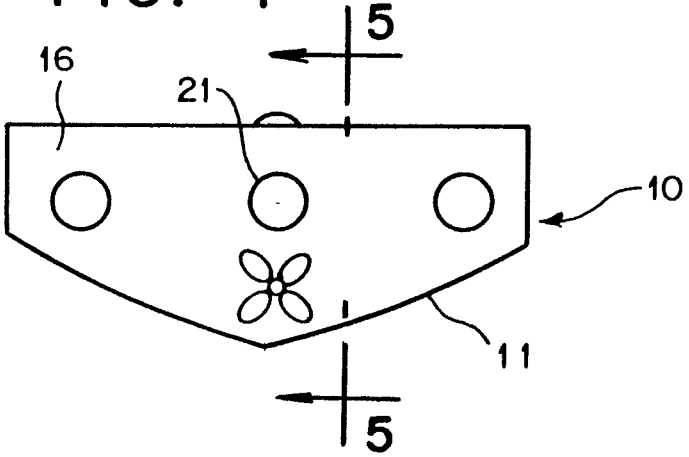
FIG. 4 is a backside elevational view of an alternate embodiment of the model boat with cigarette lighter.
Figure 5:
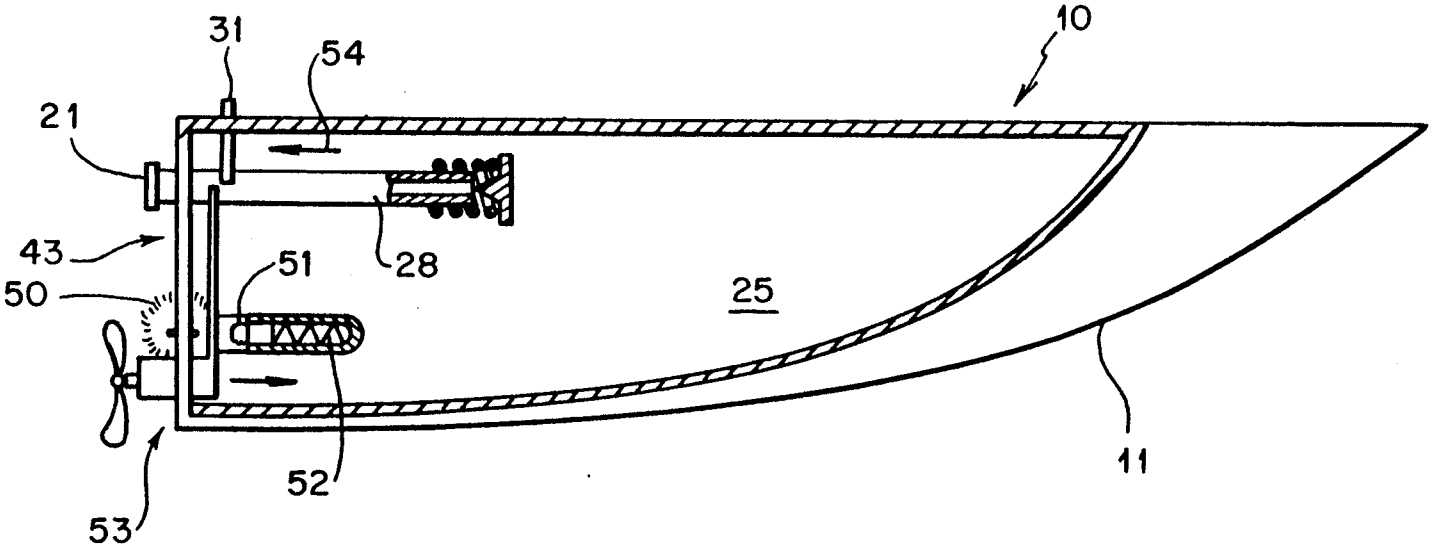
FIG. 5 is a cross-sectional view of the model boat taken along lines 5—5 of FIG. 4.

An alternate embodiment of cigarette lighter 10 is shown in FIG. 4. Cigarette lighter 10 of FIG. 4 is similar to cigarette lighter 10 of FIGS. 1, 2 and 3, except that an additional center exhaust port 21 is located on transom 16. As can be seen in FIG. 5, a butane fuel cell 25 occupies most of the space within hull 11. The ignition system of cigarette lighter 10 in FIG. 5 differs from the ignition system of FIG. 1–3, in that a flint wheel 50 is used to ignite the fuel. Flint wheel 50 rotates against a flint 51 which is held against flint wheel 50 by the biasing force of a spring 52. Rotation of flint wheel 50 in the counterclockwise direction creates friction against flint 51 and throws sparks towards gap 43 in the vicinity of slide valve 28. The propeller and outdrive assembly 53, when depressed, move slide valve 28 in the direction of arrow 54, allowing fuel to pass through slide valve 28 and exit at center exhaust port 21.

If a spark from flint wheel 50 enters gap 43 while fuel is exiting slide valve 28, then a flame will emerge from center exhaust port 21.

A flame adjustor 31 is coupled to slide valve 28 for adjusting the height of the flame. The lighter mechanism of cigarette lighter 10 in FIG. 5 operates as a conventional flint-wheel lighter. An individual who observes model boat 10 would not notice any extraneous lighter parts, but only a miniature replica of a real boat.

Cigarette lighter 10, as shown in FIGS. 1–5, can be replicas of any type of boat. The refillable quartz ignition or the disposable flint-wheel ignition system can be placed into any boat. The boats could be made of molded plastic, in the case of the disposable model boats, or be made of metal, in the case of the refillable version. Cigarette lighter 10 may include a key ring attached to a short chain for retention of keys. Also, depending on the size of cigarette lighter 10, several small batteries and a light bulb could be installed, so that cigarette lighter 10 could be used as a combination flashlight/lighter/keychain.

Accordingly, while only several embodiments of the present invention have been shown and described, it is obvious that many changes and modifications may be made thereunto without departing from the spirit and scope of the invention.

What is claimed is:

1. A gas fueled pocket cigarette lighter in the form of a miniature boat comprising:

a hollow miniature model boat replica having a first exhaust pipe and an opening therein for the cigarette lighter flame to issue therefrom;

a cigarette lighter mechanism housed entirely within said hollow miniature boat, including a fuel tank, a gas nozzle connected to said fuel tank and positioned at the flame opening of the miniature boat, a gas valve for admitting gas to said nozzle from said fuel tank and for throttling the same, said gas valve is a slide valve operatively connected to said gas nozzle for releasing said gas through said gas nozzle in a first position thereof and throttling said gas through said nozzle in a second position, and an ignition system for generating a spark a said gas nozzle to ignite the fuel exiting therefrom, said ignition system is a piezo-electric quartz ignition system;

mean forming part of said miniature model boat for activating said ignition system for generating a spark and for operating said gas valve to permit fuel to exit from said nozzle; and said means for activating including an activation mechanism for moving said gas valve between said first and second positions and simultaneously with movement to said first position activating said ignition system to produce a spark at said gas nozzle igniting the fuel exiting therefrom; said activation mechanism includes biasing means biasing said activation mechanism to the second position of said gas valve, said activation mechanism includes a guided rod operatively connected to said ignition system and a lever pivotally mounted to said rod at a first end of said lever and having a fulcrum so that movement of said rod moves said gas valve between said first and second positions; said rod of said activation mechanism generates a spark by said quartz when moved to said first position, and including conductor means for transmitting said spark to said gas nozzle; said activation mechanism being operated by means forming part of said miniature model boat; said means operating said activation mechanism is a second exhaust pipe of said miniature model boat operatively connected thereto.

2. The gas fueled pocket cigarette lighter as defined in claim 1, additionally including a refill valve assembly forming part of said miniature model boat for refilling said fuel tank.

3. A gas fueled pocket cigarette lighter in the form of a miniature boat comprising:

a hollow miniature model boat replica having a first exhaust pipe and an opening therein for the cigarette lighter flame to issue therefrom;

a cigarette lighter mechanism housed entirely within said hollow miniature boat, including a fuel tank, a gas nozzle connected to said fuel tank and positioned at the flame opening of the miniature boat, a gas valve for admitting gas to said nozzle from said fuel tank and for throttling the same, said gas valve is a slide valve operatively connected to said gas nozzle for releasing said gas through said nozzle in a first position thereof and throttling said gas through said nozzle in a said second position and an ignition system for generating a spark at the nozzle to ignite the fuel exiting therefrom;

means forming parts of said miniature model boat for activating said ignition system for generating a spark and for operating said gas valve to permit fuel to exit from said nozzle; and an activation mechanism for moving said gas valve between said first and second positions and simultaneously with movement to said first position activating said ignition system to produce a spark at said nozzle igniting the fuel exiting therefrom, said activation mechanism being operated by means forming part of said miniature model boat, wherein the means operating said activation mechanism is a second exhaust pipe of said miniature model boat operatively connected thereto.

4. The gas fueled pocket cigarette lighter according to claim 3, additionally including a refill valve assembly forming part of said miniature model boat for refilling said fuel tank.

5. A gas fueled pocket cigarette lighter in the form of a miniature boat comprising:

a hollow miniature model boat replica having an exhaust pipe and an opening therein for a cigarette lighter flame to issue therefrom;

a cigarette lighter mechanism housed entirely within said hollow miniature boat, including a fuel tank, a gas nozzle connected to said fuel tank and positioned at the flame opening of the miniature boat, a gas valve for admitting gas to said nozzle from said fuel tank and for throttling the same, an ignition system for generating a spark at the nozzle to ignite the fuel exiting therefrom; and means including an element simulating a second exhaust pipe and forming part of said miniature model boat for activating said ignition system for generating a spark and for operating said gas valve to permit fuel to exit from said nozzle and said first exhaust pipe.

* * * * *